US006170238B1

(12) United States Patent
Lerner

(10) Patent No.: US 6,170,238 B1
(45) Date of Patent: Jan. 9, 2001

(54) SEALING MACHINE AND METHOD

(75) Inventor: Hershey Lerner, Aurora, OH (US)

(73) Assignee: Automated Packaging Systems, Inc., Streetsboro, OH (US)

( * ) Notice: Under 35 U.S.C. 154(b), the term of this patent shall be extended for 0 days.

(21) Appl. No.: 09/379,091

(22) Filed: Aug. 23, 1999

Related U.S. Application Data

(60) Division of application No. 08/903,925, filed on Jul. 31, 1997, which is a continuation-in-part of application No. 08/699,129, filed on Aug. 16, 1996, now Pat. No. 5,743,070.

(51) Int. Cl.[7] ..... B65B 51/10

(52) U.S. Cl. ..... 53/479; 53/373.9; 53/284.7; 53/570; 198/626.1

(58) Field of Search ..... 53/479, 373.9, 53/468, 459, 469, 284.7, 568, 570; 226/172; 493/319, 189, 193, 198, 209; 271/272, 273, 274; 270/52.07; 198/626.1

(56) References Cited

U.S. PATENT DOCUMENTS

| | | | | |
|---|---|---|---|---|
| 3,610,501 | * | 10/1971 | Wolfelsperger | 226/172 |
| 3,665,673 | * | 5/1972 | Billet et al. | 53/441 |
| 3,887,063 | * | 6/1975 | Villanueva et al. | 226/172 |
| 4,969,310 | * | 11/1990 | Lerner et al. | 53/459 |
| 5,134,833 | * | 8/1992 | Lern et al. | 53/468 |
| 5,187,917 | * | 2/1993 | Mykleby | 53/568 |
| 5,722,218 | * | 3/1998 | Lerner | 53/468 |

* cited by examiner

*Primary Examiner*—Eugene Kim
(74) *Attorney, Agent, or Firm*—Watts, Hoffmann, Fisher & Heinke Co., L.P.A.

(57) ABSTRACT

A sealing machine and process for sealing loaded bags of a novel web of side connected bags are disclosed. The web is fed through the sealer by a pair of grooved main transport belts. A holding belt is disposed in the groove of an associated main belt and extends into the groove of the other main belt as the belts move through the seal station. Processes of transporting and sealing side connected bags are also disclosed.

25 Claims, 3 Drawing Sheets

SEALING MACHINE AND METHOD

REFERENCE TO RELATED APPLICATION

This application is a divisional of U.S. patent application Ser. No. 08/903,925 filed Jul. 31, 1997, which in turn is a continuation-in-part of U.S. patent application Ser. No. 08/699,129 filed Aug. 16, 1996 now U.S. Pat. No. 5,743,070, issued Apr. 28, 1998, by Hershey Lerner et al. under the title "Packaging Machine, Material and Method" and assigned to the assignee of this patent (the New SP Patent).

This invention relates to packaging machinery and more particularly to a packaging machine with an improved film transport conveyor for and method of sealing packages especially packages relatively heavy and liquid products.

BACKGROUND OF THE INVENTION

U.S. Pat. No. 4,969,310 issued Nov. 13, 1990 to Hershey Lerner et al. under the title Packaging Machine and Method and assigned to the assignee of this patent (the SP Patent) discloses and claims a packaging machine which has enjoyed commercial success.

While the machine of the SP Patent has been successful, a problem has been experienced in its closure section. The problem is that too frequently due to weight of the products there is slippage of bags relative to pairs of opposed belts used to transport bags through a heat sealer. In addition, slippage of the bag fronts relative to the backs occurs resulting in poor seal quality. Alternatively or additionally it is too often necessary to provide a conveyor or other support for bags as they are transported through the sealer.

SUMMARY OF THE INVENTION

With the machine of the present invention, the described bag slippage problems of the prior art and others are overcome and the need for conveyor support of bags as they pass through the sealer is eliminated.

The advantages of the present invention are accomplished through the use of novel and improved special belts which are effective substantially to prevent any product weight induced slippage of the bags relative to the belts. The novel belts are also effective to resist longitudinal movement of the face and back of each bag relative to one another and to the belts.

A pair of main transport belts are provided. The main transport belts have facing surfaces which, as they are extended in runs passing through the seal station, have external surfaces in facing closely spaced relationship. These runs form transport reaches which have longitudinally extending grooves that are preferably each in the shape of a squared "U" in cross section. In one test that has been conducted, grooves having a transverse dimension of approximately ⅛ inch and a depth of approximately 1/16 inch were used.

In the same test, a holding belt which was circular in cross section and had a diameter of ⅛ inch was used. The holding belt was disposed in the groove of one of the main transport belts such that it had a reach extending between the transport reaches of the main transport belts. With this arrangement, the holding reach of the holding belt extended into each of the grooves in the facing surfaces. This test produced a bag gripping capability of the order of four times that of the prior commercially successful belts.

In use upstanding front and back lips of bags to be sealed are trapped between one of the transport reaches or runs and the holding run or reach with the lips being clamped between the holding reach and walls defining a mating groove in which they are disposed. With heavy products the trapped lips are pulled downwardly causing the holding reach to roll slightly and more tightly clamp the bag lips against the walls of the mating groove. Where very heavy products are present, the gripping of the holding reach can be enhanced by tapering the wall defining the base of the mating groove. Further, one or more additional holding belts may be utilized to provide still greater holding power.

With such a construction, bags containing relatively heavy products are transported through the seal station as the upstanding lips are sealed. The need for a supporting conveyor under the bags being transported through the seal station is eliminated.

A series of longitudinally aligned, juxtaposed and individually biased, pressure members act against, the transport reach of one of the main transport belts. With the now preferred construction, these pressure members bias the one main belt against the bags and the holding belt and thence against the transport reach of the other main belt to in turn bias the other main belt against a backup element. While this biasing maintains pressure on the holding belt and the bag tops further to secure the bags against load induced slippage as the bags are transported through the seal section, with the present invention this biasing is primarily for another purpose. That purpose is to assure surface engagement of the main transport belts with bag lips being sealed to prevent hot gases which effect such seals from getting between the belts. Accordingly while the belts are biased together the biasing forces are, as compared with prior arrangements, significantly reduced. This reduction in biasing force results in reduced drag on the belts as well as belt wear and power required to drive the belts.

Optionally, the gripping forces may be further enhanced by utilizing an improvement disclosed in the New SP Patent. Specifically, belt surfaces at locations spaced from the heat sources which engage film being transported may be coated with a glue and sand slurry with a polyethylene coating over the slurry.

In order to prevent excessive heating of bags passing through the sealing section and the sealing section belts, the heat source for effecting the seals is shifted away from loaded bags and the belts when the machine is stopped and moved to a location adjacent the bags when the bags are moving. Thus, a mechanism is provided for shifting the heat sealer from a seal forming position to a storage position and return in synchronism with cycling of the machine when in an intermittent mode or otherwise stopped.

Lips of the bags which project from the seal section conveyor belts are heated by a contiguous heat tube sealer having an elongate opening adjacent the path of bag lip travel. Heated air and radiation emanating from this sealer effect heat seals of the upstanding lips to complete a series of packages. An adjustment mechanism is provided to adjust the angular orientation of the heat tube sealer relative to the bags path of travel.

Accordingly, the objects of this invention are to provide novel and improved package sealing machine, an improved plastic transport conveyor and methods of transporting plastic film and sealing packages.

IN THE DRAWINGS

Figure 5:
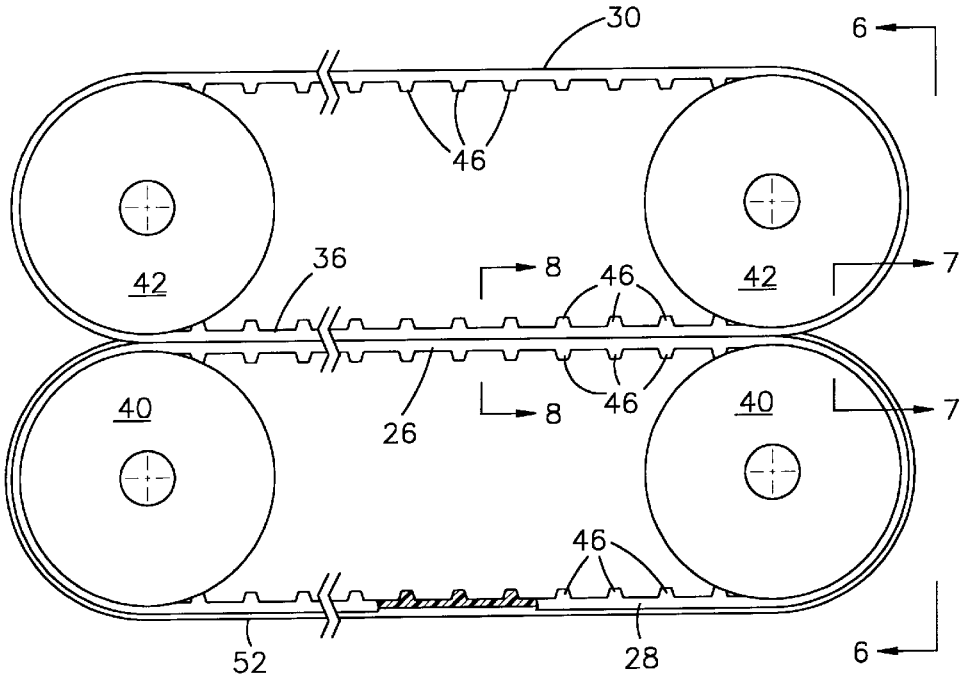
FIG. 5 is a plan view on an enlarged scale with respect to FIGS. 3 and 4 of a novel conveyor system for the closure section.
Figure 6:
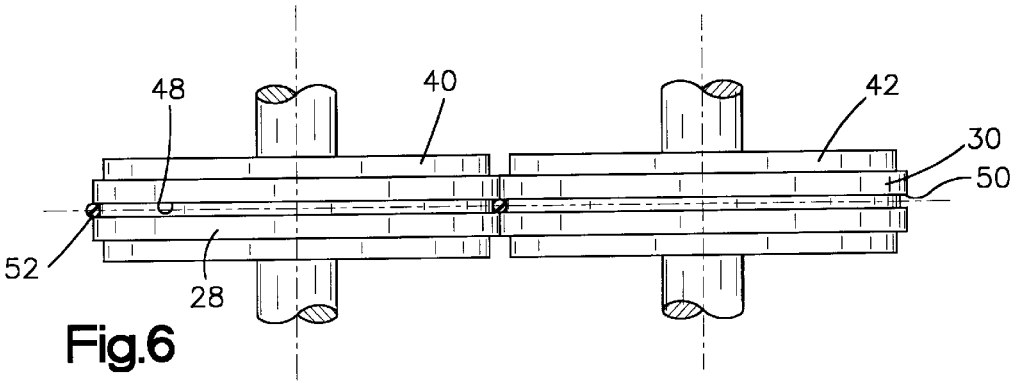
Figure 7:
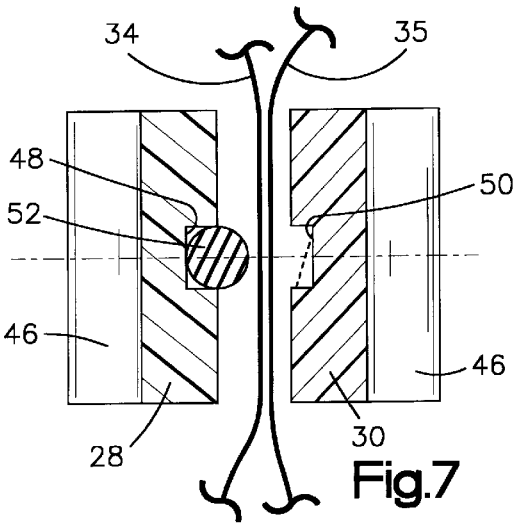
Figure 8:
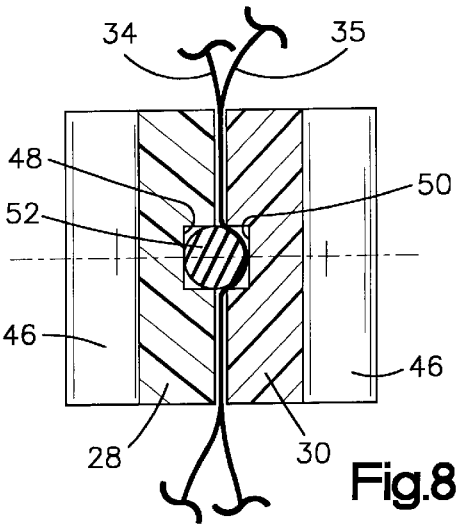

FIG. 6 is an end elevational view of the mechanism of FIG. 5 as seen from the plane indicated by the line 6—6 of FIG. 5; and, FIGS. 7 and 8 are enlarged sectional views of the conveyor belts of the present invention showing lips of transported bags about to be sealed with the views as seen respectively from the planes indicated by the lines 7—7 and 8—8 of FIG. 5.

DETAILED DESCRIPTION OF THE PREFERRED EMBODIMENT

Figure 1:
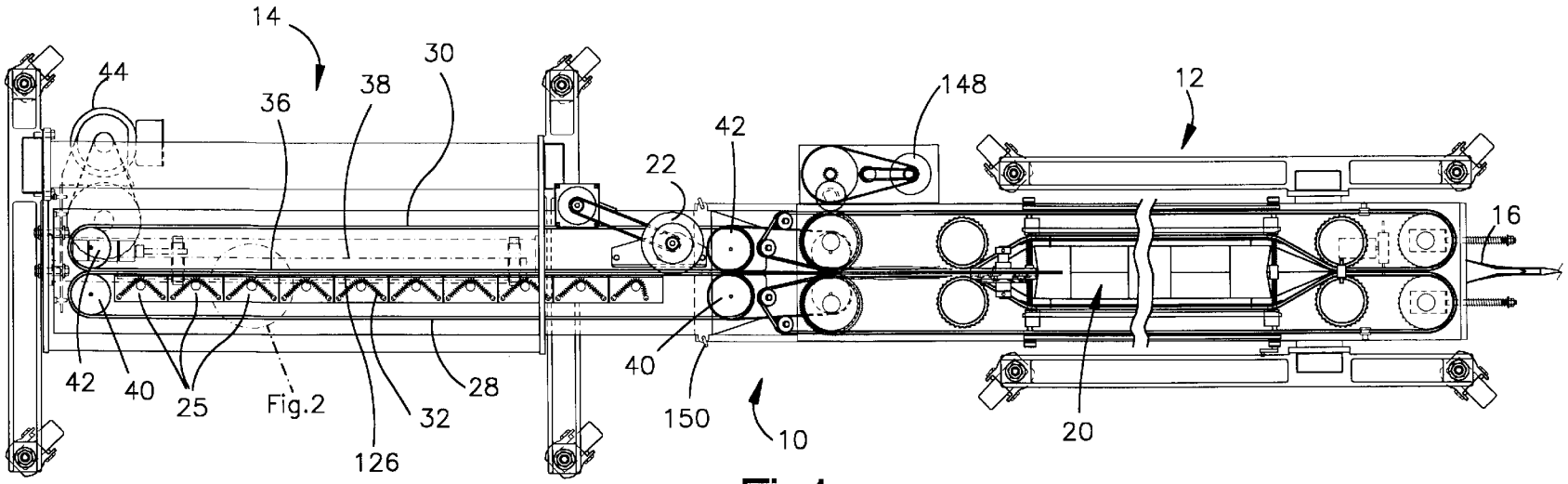
FIG. 1 is a top plan view of the machine of the new SP Patent.

Referring to the drawings and FIG. 1 in particular, a plan view of the machine of the New SP Patent is shown generally at 10. The machine includes a bagging section 12 and a closure section 14. The functioning and the operation of the bagging and closure sections is described more fully in the New SP Patent which is hereby incorporated by reference. Briefly, a web 16 of side connected open bags 18 (FIG. 4) is fed through a load station 20 where products are inserted. After loading, the bags are reclosed. After closure, the bags are fed through a trimmer 22 and into the closure section 14.

The Closure Section Conveyors

Figure 2:
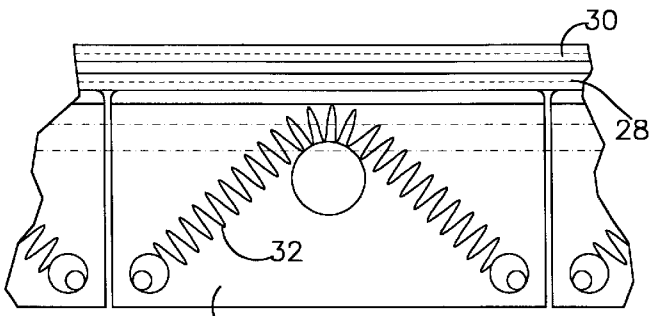
FIG. 2 is an enlarged plan view of a fragmentary section of the sealer conveying mechanism.

As is best seen in FIG. 1, the novel and improved section 14 includes a plurality of independently movable force application elements 25. One of the force elements is shown on an enlarged scale in FIG. 2. The force elements 25 slidably engage the outer surface of a bag transport run 26 of one of a pair of main transport belts 28,30 forming a conveyor. Springs 32 bias the elements 25 to clamp bag lip faces and backs 34,35 together against a coacting run 36 of the conveyor belt 30. A backup 38 slidably engages the coacting run 36 to resist the spring biased force of the application elements 25. With the present construction the purpose of the biasing is to limit sealing heat impingement on the transport belts to the belt surfaces which are the upper surfaces in the orientation shown in the drawings.

The novel and improved closure section conveyor is best understood by reference to FIGS. 5 through 8. The main transport belts 28,30 are respectively reeved around spaced pairs of pulleys 40,42 to function as a bag transport conveyor for transporting bags being sealed through a sealing station of the closure section 14. A stepper motor 44 is drivingly connected to the left hand ones, as viewed in FIG. 1, of the pulley pairs 40,42 to drive the conveyor.

As is best seen in FIG. 5, the belts 28, 30 are timing belts having spaced timing cogs 46. The cogs 46 engage recesses, not shown, in the pulleys 40,42 which are conventional timing belt pulleys. Adjacent cogs are spaced a distance less than a longitudinal dimension of each of the force elements 25, such that the force elements are each at all times in engagement with at least one of the cogs 46.

As is best seen in FIG. 6, the main transport belts 28,30 respectively include perimeteral grooves 48,50. Preferably the grooves each have a depth ½ their width, such that when mated along their bag engaging or transport runs 26,36, they define an aperture that is square in cross section.

An endless holding belt 52 is stretched around the transport belt 28 and positioned in that belts recess 48. As is best seen in FIGS. 7 and 8, the holding belt is circular in cross section and of a diameter equal to the width of the grooves 48,50, such that it substantially engages the four sides of the square delineated by the grooves in their transport runs. As is best illustrated in FIGS. 7 and 8, as paired bag lips 34,35 are fed toward the transport and sealing runs, they are trapped between the main transport belts 28,30 and forced by the holding belt 52 into the groove 50, such that the lips are wrapped around the holding belt and forced into the groove 50.

Under some circumstances, the transport and holding belts 28,52 function as a single belt and can be replaced by a single belt. However, the provision of a separate holding belt produces one of the outstanding advantages of the invention. Forces applied to the lips 34,35, such as by heavy objects in the supported bags, tend to pull down on the lips and against the holding belt 52. Such forces distort the holding belt 52 with the distortion in turn resulting in the gripping force between the holding belt and the groove 50 being increased, such that slippage of the lips relative to the belts is virtually eliminated.

Preferably bottom walls of the grooves 48,50 taper inwardly and downwardly as shown in dotted lines in FIG. 7. With this construction, the holding power of the belts increases proportionately with an increase of downward forces applied to the bag lips 34,35 due to compression of the holding belt 52. Moreover, the useful life of the holding belt 52 is increased because the taper of the bottom walls compensates for wear of the holding belt 52.

The Preferred Sealer

Figure 3:
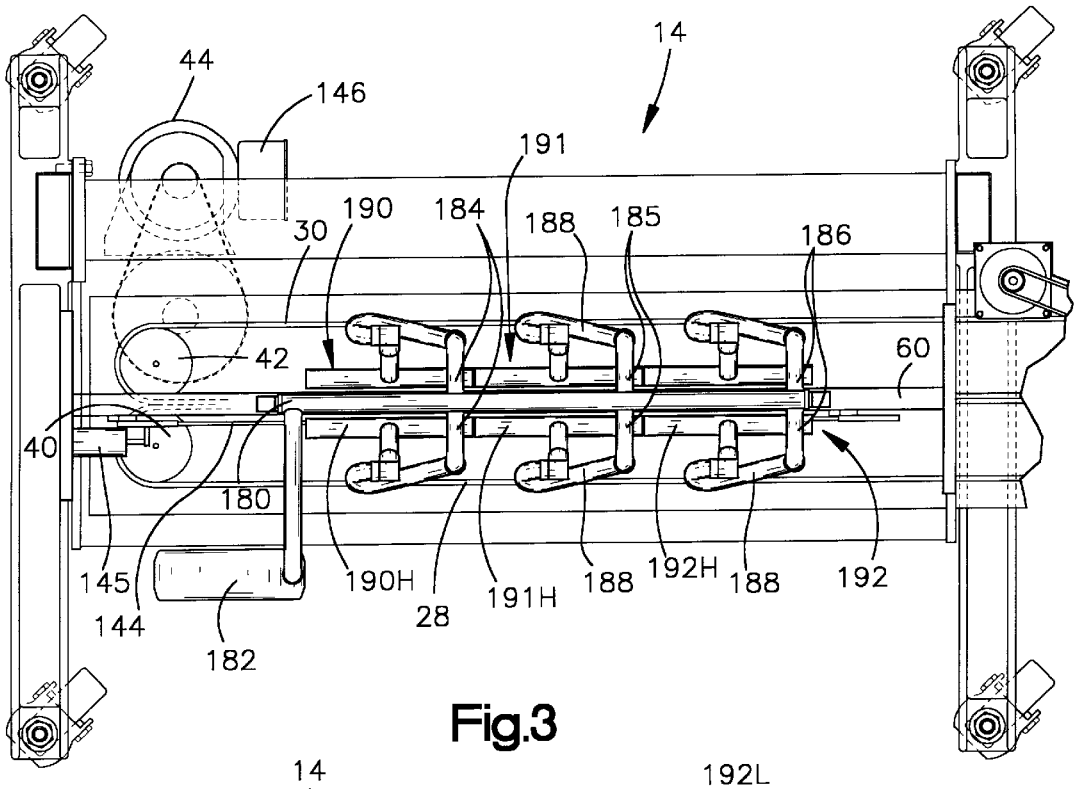
FIG. 3 is a plan view of the preferred sealer mechanism of the present invention.
Figure 4:
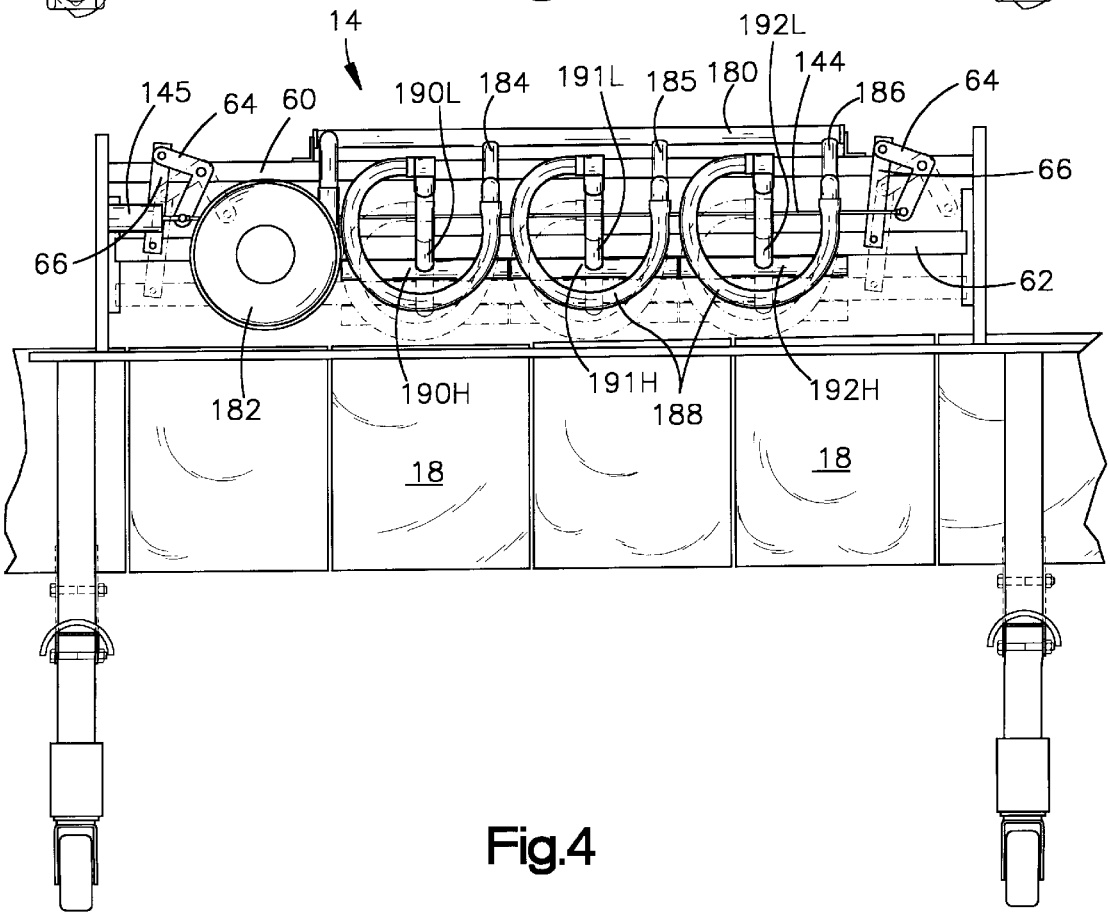
FIG. 4 is a front elevational drawing of the mechanism of FIG. 3.

Referring to FIGS. 3 and 4, the preferred sealer for the closure section 14 is disclosed. The closure section includes a horizontally disposed sealer support bar 60 forming a part of a closure section frame. The sealer includes an air manifold 180 fixedly mounted on the support bar 60 for receiving air from a blower 182. In an experimental prototype a 300 cubic foot per minute variable pressure blower was used to determine optimized air flows and pressures.

The manifold 180 has three pairs of oppositely disposed outlets 184,185,186. Each outlet is connected to an associated one of six flexible tubes 188. The tubes in turn are connected to pairs of oppositely disposed, T-shaped sealer units 190,191,192. Thus, the tubes 188 respectively connect the units to the outlets 184,185,186.

The sealer units 190,191,192 are supported by a vertically movable support bar 62. L-shaped links 64 are pivotally connected to the sealer support bar 60. Support links 66 pivotally interconnect the L-shaped links 64 and the movable support bar 62.

The L-shaped links are also pivotally connected to a position control rod 144. A cylinder 145 selectively shifts the control rod 144 to move the movable support bar 62 between a storage position shown in solid lines in FIG. 4 and a sealing position shown in phantom lines. Since the sealer units 190,191,192 are connected to the manifold by the flexible tubes 188, they are able to move between their solid and phantom line positions while the manifold 180 remains stationary.

The overall machine may be operated in either a continuous mode or an intermittent mode. The sealer units are only moved to their sealing positions when the motor 44 is operating. To this end a machine control 146, FIG. 3, is connected to the motor 44, the cylinder 145 and a closure section motor 148.

The T-shaped sealer units respectively include tubular legs 190L, 191L, 192L extending vertically downward from their respective connections to the flexible tubes 188 to horizontal air outlet sections 190H,191H,192H. The outlet sections are closely spaced, axially aligned, cylindrical tubes which collectively define a pair of elongate heater mechanisms disposed on opposite sides of an imaginary vertical plane through the loaded bag path of travel.

Each horizontal outlet section includes an elongate slot for directing air flow originating from the blower 182 onto upstanding bag lips being sealed. Each of the sealer unit legs 191,192 houses an associated heater element of a type normally used in a toaster. Thus air flowing through the T-shaped units 191,192 is heated and the escaping hot air effects seals of the upstanding bag lips. Air flowing through the units 190 is not heated, but rather provides cooling air to accelerate solidification of the seals being formed.

A further unique feature of the embodiment of FIGS. 3 and 4 is a vertical adjustment mechanism. The vertical adjustment permits adjustment of the vertical turret of the support bars 62 as well as the slope of the support bar and the horizontal sections of the T-shaped units 190–192 such that the outlet from 191H is lower than that of 192H. This downward sloping of the heater mechanism in the direction of bag travel assures optimized location of the hot air being blown on the plastic. The location is optimized because as the plastic melts it sags lowering the optimum location for the direction of the hot air. Further the cooling air from the unit 190 is directed onto a now formed bead.

The control rod 144 has oppositely threaded end portions threadedly connected to the L-shaped links 64. Height adjustment of the support rod is accomplished by rotating the rod 144 relative to both links. Angular adjustment is accomplished by individual relative rotation of the link to rod connections one at a time or oppositely.

Although the invention has been described in its preferred form with a certain degree of particularity, it is understood that the present disclosure of the preferred form has been made only by way of example and that numerous changes in the details of construction, operation and the combination and arrangement of parts may be resorted to without departing from the spirit and the scope of the invention as hereinafter claimed.

What is claimed is:

1. A plastic film transporting system comprising:

a) a pair of main transport belts each having external surfaces for facing relationship along a transport reach when the belts are in use;

b) the external surfaces each having a longitudinally extending recess formed therein;

c) the recesses being in facing aligned relationship along such transport run when the belts are in use; and d) a holding belt for positioning between the external surfaces along the transport reach with spaced portions respectively partially disposed in the main belt recesses whereby a film being transported is gripped between the surfaces and between the holding belt and one of the recesses to hold said film against forces applied of the transport reach.

2. The system of claim 1, wherein the holding belt is around one of the transport belts and disposed in part within the recess of the one belt.

3. The system of claim 2, wherein the holding belt is circular in cross section.

4. The system of claim 1, wherein the holding belt is circular in cross section.

5. The system of claim 1, wherein the recesses are rectangular in cross section and form an elongate passage of square cross section along the reach.

6. The system of claim 5, wherein the holding belt is circular in cross section and of a diameter substantially equal to the transverse dimension of the passage.

7. The system of claim 1, wherein at least one recess base is tapered relative to the external surface such that the recesses define an elongate passage that is trapezoidal in cross section.

8. The system of claim 7, wherein the holding belt is circular in cross section.

9. The system of claim 1, wherein each of the belts is endless.

10. A process of gripping and transporting plastic film along a path, comprising:

a) positioning the film between grooved opposing faces of transport reaches of a coacting pair of endless transport belts;

b) gripping the positioned film between an endless holding belt and walls defining the groove in one of the transport belts;

c) moving the belts to advance the gripped film along a path of travel; and d) allowing the holding belt to shift transversely in response to film applied forces and thereby increasing the gripping of the film between the holding belt and the walls defining such grooves whereby to resist film slipping induced by forces applied to the film laterally of the path.

11. The process of claim 10, further including the step of applying a compressive force to the transport belts to increase the force of the film gripping and thereby resist slippage of the film in response to transverse forces applied to the gripped film.

12. The process of claim 11, further including the step of allowing the holding belt to deform in response to such transverse forces and thereby increase the force of the film gripping.

13. The process of claim 10, wherein the holding belt is around the other of the transport belts and disposed in part within the groove of the one belt.

14. A conveyor system for transporting plastic film through a work station comprising:

a) a pair of endless flexible main belts each having an outer generally flat face in a direction transverse to a belt path of travel;

b) each face including an endless groove disposed in the face between spaced side positions of the face;

c) a pair of pulley sets;

d) each pulley set carrying one of the main belts with reaches of the belts in confronting relationship, the reaches extending through the work station;

e) an endless, flexible holding belt carried by one of the main belts and positioned at least partially within the groove of the one belt; and f) the holding belt extending into a portion of the groove of the other belt with the groove portion being in the reach of the other belt whereby in operation portions of plastic film pieces may be trapped between the holding belt and walls defining said groove portion for transport of the pieces through the work station while resisting slippage of the film relative to the belts due to forces applied to the film as the film is transported through the work station.

15. In a plastic film transport mechanism, the improvement comprising:

a) a frame supporting a plurality of rotatable elements;

b) a pair of main transport belts respectively mounted on associated ones of said elements;

c) the,belts each having a transport reach extending through a sealing station;

d) the transport reaches including closely spaced facing surfaces;

e) the facing surfaces each including an elongate recess extending longitudinally through the sealing station, the recesses being transversely aligned; and f) a holding belt carried by the elements and including a holding reach extending longitudinally through the sealing station and having portions extending into both of the recesses whereby a film being transported is gripped between the surfaces and between the holding belt and one of the recesses to hold such film against forces applied laterally of the transport reach.

16. The mechanism of claim 15, further including structure carried by the frame and biasing the transport reaches toward one another with the holding reach trapped therebetween.

17. The mechanism of claim 15, wherein the recesses together form an elongate passage of square cross section along the reaches.

18. The mechanism of claim 17, wherein the holding belt is circular in cross section and of a diameter substantially equal to the transverse dimension of the passage.

19. The mechanism of claim 15, wherein the holding belt is around one of the transport belts and disposed in part within the recess of the one belt.

20. The mechanism of claim 19, wherein the holding belt is circular in cross section.

21. The mechanism of claim 15, wherein the holding belt is circular in cross section.

22. A film transporting machine comprising:

a) a frame;

b) a pair of belt conveyors mounted on the frame, the conveyor belts having juxtaposed reaches delineating a path of travel through a work station;

c) the belts each including an endless peripheral groove including a portion extending through the station;

d) a coacting belt including a section extending into the portions through the station in plastic film gripped relationship; and e) drive means for driving the belts in continuous operation for transporting work pieces at constant and continuous flow rates through such station whereby a film being transported is gripped by the juxtaposed reaches and by the coacting element to hold such film against lateral forces applied to such film as it is transported through such station.

23. The machine of claim 22, wherein said another belt is circular in cross section.

24. A machine for transporting plastic film for a work operation comprising:

a) frame structure;

b) a pair of opposed conveyor belts carried by the structure and having complemental reaches established a path of travel for loaded bags through a work station, the belts having complemental recesses in respective surfaces of the belts;

c) a work performing mechanism supported by the structure and positioned adjacent the path; and d) the belts including a third belt having a reach disposed in an elongate space defined by the complemental recesses to provide slippage prevention means for preventing relative longitudinal movement of juxtaposed film layers as such layers are moved along the path whereby a film begin transported is gripped by the juxtaposed reaches and the third belt to hold such film against forces applied to such film as it is transported.

25. The machine of claim 24, wherein said third belt is circular in cross section.

* * * * *